US007780398B2

(12) United States Patent
Dervaux et al.

(10) Patent No.: US 7,780,398 B2
(45) Date of Patent: Aug. 24, 2010

(54) BLADED STATOR FOR A TURBO-ENGINE

(75) Inventors: Alexandre Nicolas Dervaux, Paris (FR); Patrick Joseph Marie Girard, Melun (FR); Gael Loro, Combs la Ville (FR); Guillaume Jean-Claude Robert Renon, Vaux le Penil (FR)

(73) Assignee: SNECMA, Paris (FR)

( * ) Notice: Subject to any disclaimer, the term of this patent is extended or adjusted under 35 U.S.C. 154(b) by 518 days.

(21) Appl. No.: 11/566,858

(22) Filed: Dec. 5, 2006

(65) Prior Publication Data

US 2007/0128020 A1 Jun. 7, 2007

(30) Foreign Application Priority Data

Dec. 5, 2005 (FR) ..... 05 12295

(51) Int. Cl.
*F01D 9/00* (2006.01)

(52) U.S. Cl. ..... 415/1; 415/199.4; 415/208.2; 415/209.2

(58) Field of Classification Search ..... 415/198.1, 415/199.4, 208.1, 208.2, 209.2, 209.3, 209.4, 415/210.1, 211.2
See application file for complete search history.

(56) References Cited

U.S. PATENT DOCUMENTS

| | | | | |
|---|---|---|---|---|
| 3,781,125 | A | 12/1973 | Rahaim et al. | |
| 4,511,306 | A * | 4/1985 | Hultgren | 415/136 |
| 5,071,313 | A * | 12/1991 | Nichols | 415/134 |
| 5,343,694 | A * | 9/1994 | Toborg et al. | 60/796 |
| 6,210,108 | B1 * | 4/2001 | Ebacher | 415/189 |
| 6,679,679 | B1 | 1/2004 | Debeneix et al. | |

* cited by examiner

*Primary Examiner*—Igor Kershteyn
(74) *Attorney, Agent, or Firm*—Oblon, Spivak, McClelland, Maier & Neustadt, L.L.P.

(57) ABSTRACT

A bladed stator sector for a turbo-engine reduces the occurrence of thermally-induced stress cracks in stator blades by increasing the flexibility of the sectors by using one or more cutouts. The stator sector includes at least one stator blade between inner and outer platforms and at least one flange on one or more of the platforms. Each flange has a first end portion fixed to one of the platforms and a second end portion that is not fixed to either of the platforms. The one or more cutouts may be located on the flange and may be non-opening.

12 Claims, 4 Drawing Sheets

BLADED STATOR FOR A TURBO-ENGINE

BACKGROUND OF THE INVENTION

I. Field of the Invention

The present invention relates to the field of turbo-engines, in particular an improved bladed stator for a turbo-engine.

II. Description of Related Art

An aeronautical turbo-engine conventionally comprises a compressor, a combustion chamber and a turbine. The role of the turbine is to provide the rotary drive of the compressor by taking part of the pressure energy of the hot gases leaving the combustion chamber and converting it into mechanical energy.

The turbine, located downstream of the combustion chamber, is the element of the turbo-engine which works in the severest conditions. In particular, it is subjected to great thermal and mechanical stresses generated by the hot gases leaving the chamber.

An axial turbine conventionally comprises at least one stator, consisting of a row of blades which are fixed in relation to the housing of the turbo-engine, and at least one rotor disk, comprising a set of blades which is capable of being set in rotation.

The stator blades are in general fixed radially in relation to the axis of rotation of the turbo-engine on two concentric annular shrouds, referred to as the inner shroud and the outer shroud, one end of the blades being connected to the inner shroud and another end of the blades being connected to the outer shroud.

The stator can be divided into sectors, each sector being provided with a plurality of blades. On a turbo-engine, the stator sectors are fixed to a fixed annular housing. Mounting a plurality of identical sectors connected end to end in a ring on a fixed annular housing makes it possible to reconstitute the stator. The stator sectors comprise an axis of revolution which is coaxial with the axis of rotation of the turbo-engine.

On a stator sector, the inner shroud and outer shroud portions are respectively called the inner platform and the outer platform. The space defined between the inner platform and the outer platform constitutes an air stream in which air originating from the combustion chamber flows.

The platforms comprise parts exposed directly to the air stream and other, non-exposed parts. Consequently, the parts exposed to the hot gases, such as the surfaces delimiting the air stream, will expand more rapidly than the non-exposed parts, such as flanges described in detail below.

Furthermore, the platforms are more solid pieces than the blades. Therefore, the platforms have a greater thermal inertia than the blades, which has two consequences: under the effect of an increase in temperature, on the one hand the blades will expand more rapidly than the platforms, and on the other hand the platforms will impose their deformation on the blades. This phenomenon is also called the bimetallic effect.

During the various phases of flight of an aircraft equipped with a turbo-engine, the stator undergoes heating and cooling, which deforms the inner and outer platforms. Under the effect of these deformations, the blades of the stator are subjected to a succession of traction and compression, and this leads to the appearance of cracks which are detrimental to the lifetime of the blades.

To solve these problems, a solution known from the prior art consists in designing stator sectors with platforms which are not very solid. However, this solution is far from satisfactory because the mechanical behavior of such stator sectors is affected by it.

SUMMARY OF THE INVENTION

The object of the present invention is to solve the problems mentioned above by proposing a stator with more flexibility.

To this end, the invention relates to a bladed stator sector for a turbo-engine comprising an inner platform and an outer platform, at least one blade fixed between said platforms, at least one of said platforms comprising at least one flange having a first end fixed to the platform and a second, free end, wherein said flange comprises at least one free flexibility-increasing cutout.

The flange can be either a radial flange or a semi-cylindrical flange.

According to the invention, this cutout is made in a non-opening manner.

Advantageously, such a cutout can easily be added to stator sectors which already exist by various known machining techniques. It is therefore possible to increase the flexibility of stator sectors which have already been put on the market.

The present application therefore also relates to a method for increasing the flexibility of stator sectors, which consists in machining at least one non-opening cutout in at least one flange of a stator sector.

DESCRIPTION OF THE DRAWINGS

The invention will be better understood and other features and advantages of the invention will emerge on reading the rest of the description, which is given by way of non-limiting example with reference to the accompanying drawings, in which.

DESCRIPTION OF THE PREFERRED EMBODIMENTS

Figure 1:
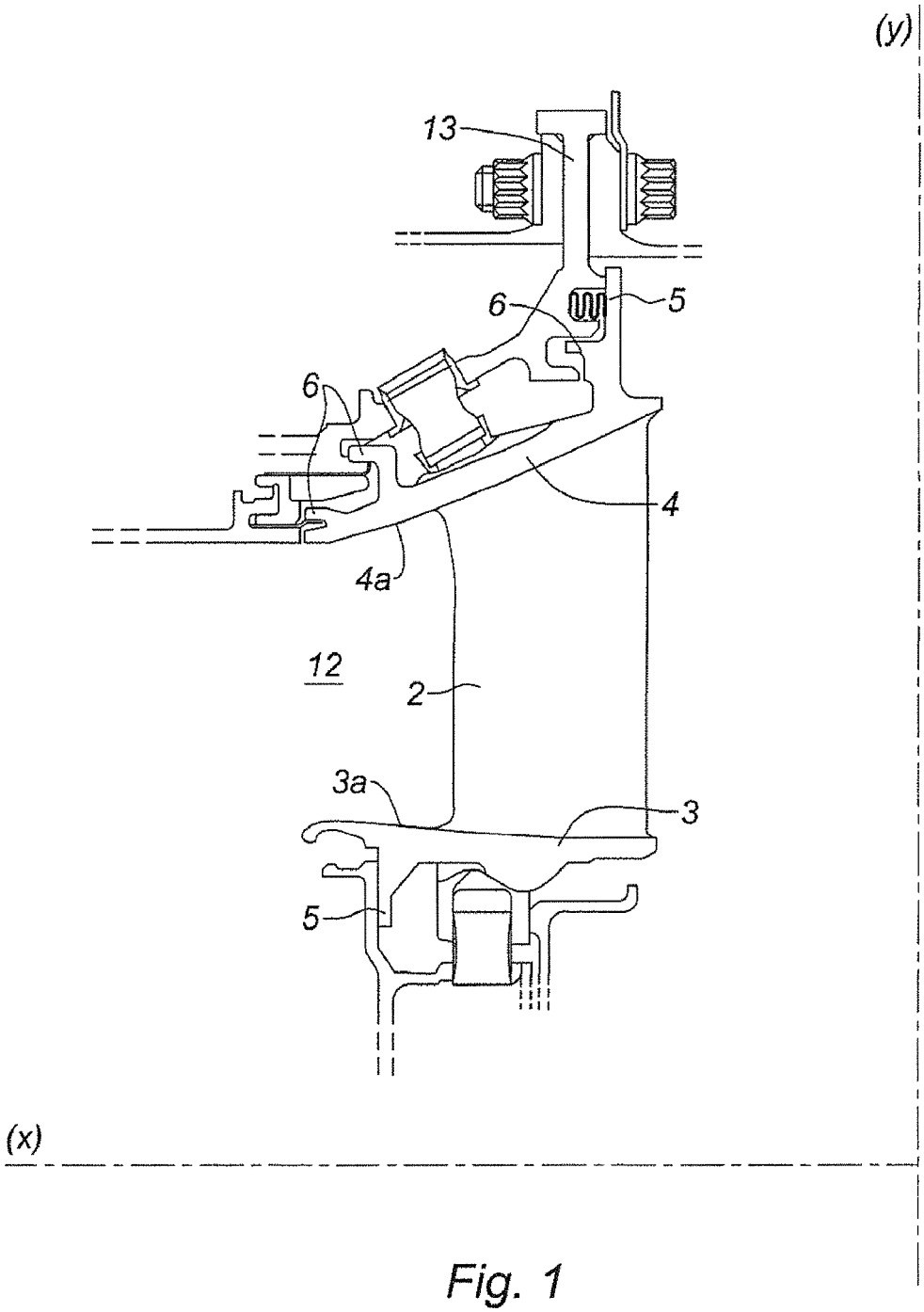
FIG. 1 shows a view in section of the region of a turbo-engine in which the stator sector is located.

FIG. 1 illustrates in a sectional view a stator sector 1 installed on a turbo-engine. At least one guide blade 2 is fixed radially to this stator sector 1 in relation to the axis of revolution X of said stator sector 1, between an inner platform 3 and an outer platform 4. On a radial axis Y intersecting the axis of revolution X at right angles, an inner platform 3 is located at a smaller distance from this axis X than an outer platform 4.

This blade 2 is exposed directly to the hot gases originating from the combustion chamber. The platforms 3 and 4 comprise parts exposed directly to the air originating from the combustion chamber, in particular the surfaces 3*a* and 4*a* delimiting the air stream 12, and other parts which are not exposed to this air.

During functioning of the turbo-engine with stabilized operation, there is a permanent thermal gradient over the various parts of a stator sector 1 which imposes permanent deformation of this stator sector 1.

In transient operation, that is to say during heating due to an increase in the speed of the turbo-engine or cooling due to reduction in this speed, a stator sector 1 undergoes progressive deformations.

In the course of a complete functioning operation of the turbo-engine, for example in the course of a complete flight of an aircraft comprising such a turbo-engine, these deformations can lead to the appearance of cracks on this stator sector 1 and cause damage to the turbo-engine.

Figure 2:
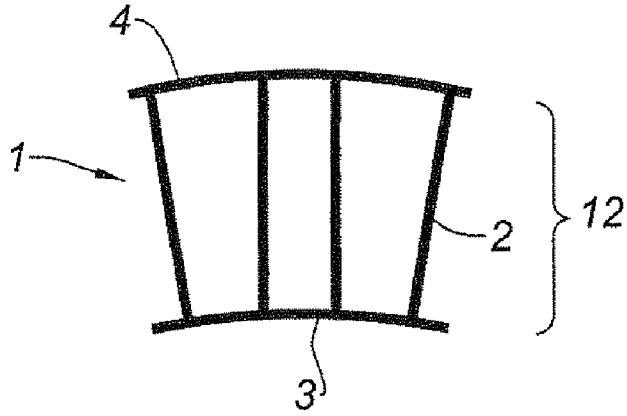
FIG. 2 shows a diagrammatic view of a stator sector at rest.
Figure 3:
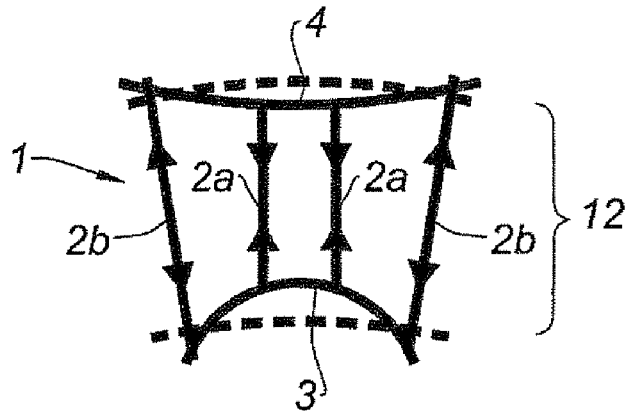
FIG. 3 shows a diagrammatic view of a stator sector during a heating phase.
Figure 4:
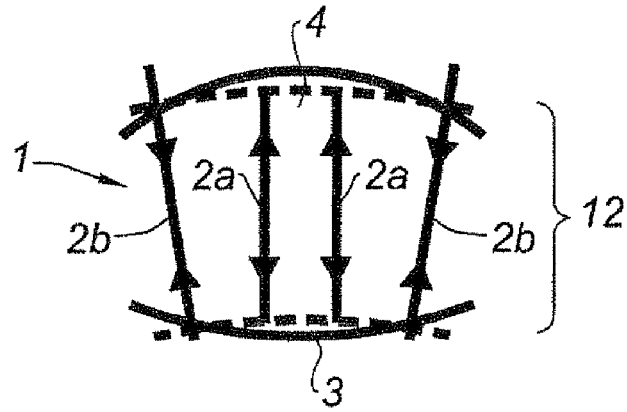
FIG. 4 shows a diagrammatic view of a stator sector during a cooling phase.

FIGS. 2, 3 and 4 show different phases of functioning of a stator sector 1.

FIG. 2 illustrates diagrammatically a stator sector 1 at rest, that is to say when the turbo-engine is stopped. No thermal or mechanical stress is exerted on the stator sector 1.

FIG. 3 illustrates diagrammatically a stator sector 1 during a heating phase. The heating phase, the most important in the course of a flight, is observed at the time of take-off of the aircraft. In the course of this heating phase, the inner and outer platforms 3 and 4 are deformed and their surfaces 3*a* and 4*a* exposed to the air stream 12 have a tendency to become convex facing this stream 12. The result is that the blades 2*a* located in the center of the stator sector 1 undergo compression and the blades 2*b* located at the periphery undergo traction.

FIG. 4 illustrates diagrammatically a stator sector 1 during a cooling phase. Conversely, in the course of the cooling phase, the inner and outer platforms 3 and 4 are deformed and their surfaces 3*a* and 4*a* exposed to the air stream 12 have a tendency to become concave facing this stream 12. The result is that the blades 2*a* located in the center of the stator sector 1 undergo traction and the blades 2*b* located at the periphery undergo compression.

The deformations of the inner and outer platforms 3 and 4 contribute to the appearance of cracks on the stator sectors. It is therefore necessary to reduce the deformation of the platforms 3 and 4 in order to extend the lifetime of the stator sectors and in particular of the blades 2, a blade generally being the piece with the shortest lifetime on a stator sector 1.

Figure 5:
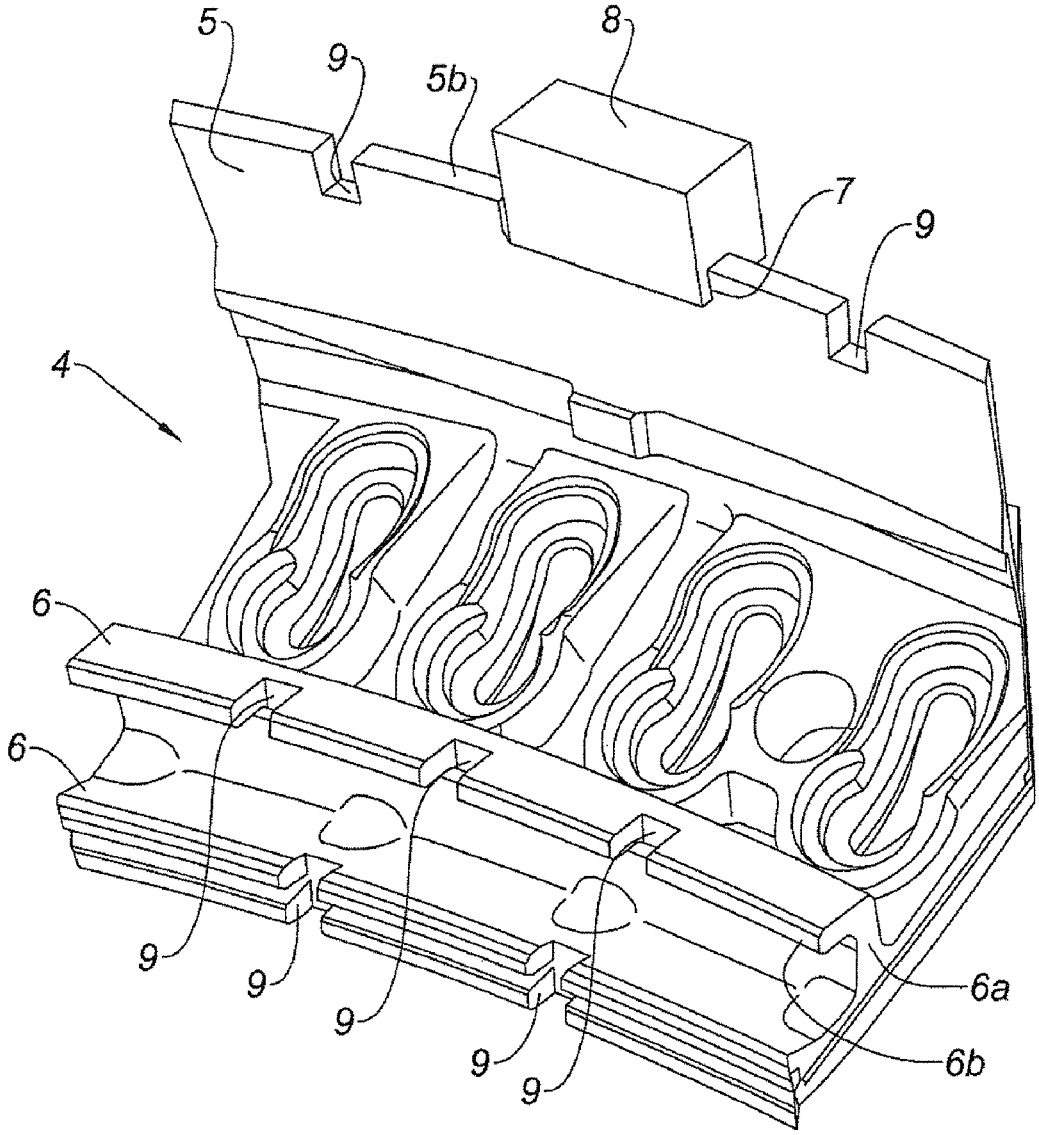
FIG. 5 shows a perspective view of an outer platform of a stator sector comprising opening cutouts.
Figure 6:
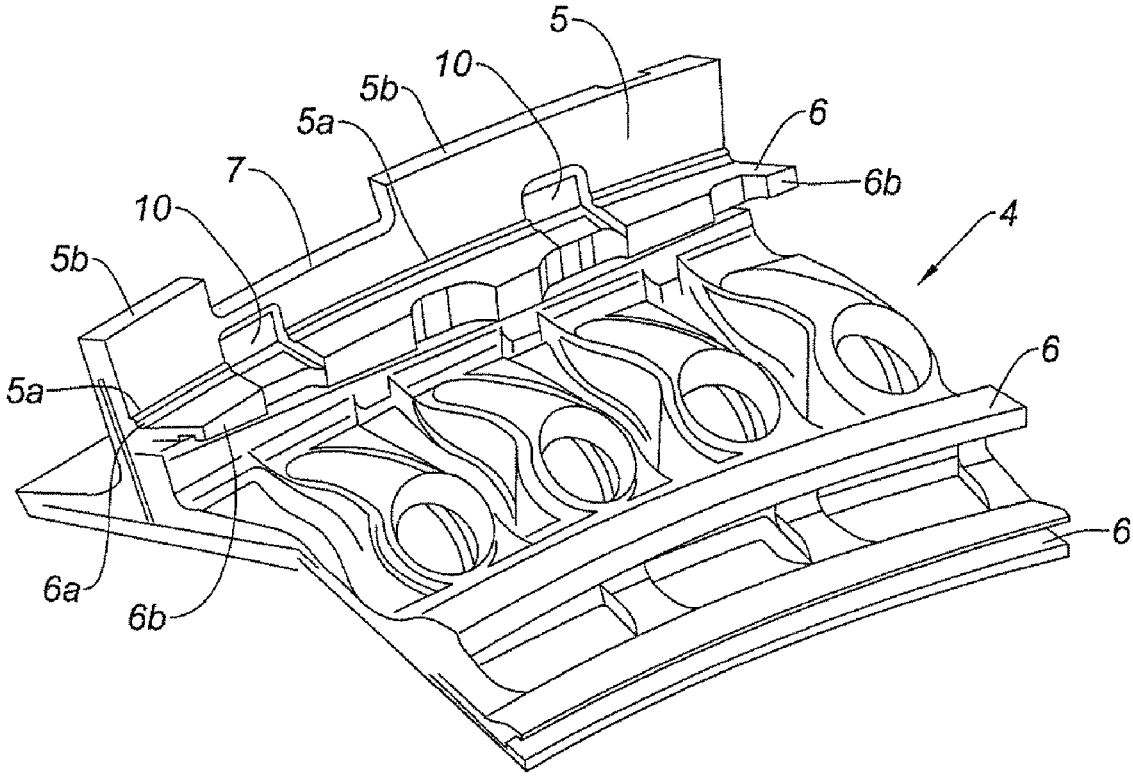
FIG. 6 shows a perspective view of an outer platform of a stator sector comprising non-opening cutouts according to the invention.

The platforms 3 or 4 of a stator sector 1 can comprise at least one flange 5 known as a radial flange or at least one semi-cylindrical flange 6, as shown in FIGS. 5 and 6. A flange 5 or 6 comprises a first end 5*a* or 6*a* fixed to the platform 3 or 4 and a second, free end 5*b* or 6*b*, that is to say an end which is not fixed to the platform 3 or 4.

A radial flange 5 extends in a plane intersecting the axis of revolution X of the stator sector 1 at right angles. The radial flange 5 effects axial locking and sealing in the vicinity of the platforms 3 or 4 of the stator sector 1. Axial locking is the limitation of any movement of translation of the stator sector 1 in relation to the fixed annular housing 13 in a direction parallel to the axis of revolution X.

A semi-cylindrical flange 6 extends cylindrically in relation to the axis of revolution X of the stator sector 1. A flange is semi-cylindrical in that it only extends over a portion of a cylinder corresponding to a stator sector. The semi-cylindrical flange 6 effects radial locking and sealing in the vicinity of the platforms 3 or 4 of the stator sector 1. Radial locking is the limitation of any movement of translation of the stator sector 1 in the direction of a radial axis Y intersecting the axis of revolution X at right angles.

At least one locking means on these flanges allows tangential locking in relation to the fixed annular housing 13, the latter comprising a complementary means which interacts with this tangential locking means. Tangential locking is the limitation of any lateral movement of a stator sector 1 toward the adjacent stator sectors.

This tangential locking means can be an indentation 7 intended to interact with a complementary lug 8 on the fixed annular housing 13 of the turbo-engine, as shown in FIG. 5, or, conversely, a lug intended to interact with a complementary indentation on the fixed annular housing 13 of the turbo-engine.

According to the invention, at least one flange 5 or 6 of the stator sector 1 moreover comprises at least one non-opening free flexibility-increasing cutout 10. A cutout is a removal of material from a piece. It may be opening or not. In the sense of the present invention, a "free cutout" is to be understood as a cutout which is not intended to interact with a complementary means, for example to effect any locking.

FIG. 5 shows an outer platform 4 of a stator sector 1 comprising a radial flange 5 and semi-cylindrical flanges 6. These flanges 5 or 6 can also be present on an inner platform 3. The inner platform 3, which functions according to the same principles, will not be described in detail.

In this example, the cutout 9 is opening and is in the form of a notch 9. These notches 9 increase the flexibility of the platform 4 of the stator sector 1. They make it possible to reduce the sensitivity of the blades to the deformations of the stator sector 1 mentioned above and to extend its lifetime. These free flexibility-increasing notches 9 are preferably located on the second, free end 5*b* or 6*b* of a flange 5 or 6. Such opening cutouts are known from the documents U.S. Pat. Nos. 3,781,125 and 6,210,108.

FIG. 6 shows an outer platform 4 of a stator sector 1 according to the invention comprising a radial flange 5 and semi-cylindrical flanges 6.

The cutout 10 is non-opening. These cutouts 10 consist of holes 10 made in the flanges 5 and 6 of the stator sector 1. Such holes 10 likewise make it possible to improve the resistance to the deformations mentioned above of the stator sector 1 and to extend its lifetime. These holes 10 are preferably located on the first end 5*a* or 6*a*, fixed to the platform 3 or 4, of a flange 5 or 6.

Each stator sector 1 is fixed to a fixed annular housing 13 of the turbo-engine. The assembly of the stator sectors 1 and of the annular housing 13 constitutes a bladed stator.

These cutouts 10 can be obtained by various machining techniques known per se. These cutouts 10 can advantageously be made in stator sectors which already exist. It is therefore possible to increase the flexibility of stator sectors which have already been put on the market.

The present application likewise relates to a method for increasing the flexibility of a stator sector 1 comprising at least one blade 2 and at least one flange 5 or 6 which consists in machining at least one cutout 10 in at least one flange 5 or 6 of the stator sector 1.

The invention claimed is:

1. A bladed stator sector for a turbo-engine, comprising:

platforms including an inner platform and an outer platform; and at least one blade fixed between said platforms, wherein at least one of said platforms comprises a first flange extending in a radial plane in relation to an axis of revolution of said stator sector, the first flange includes a first end of the first flange fixed to the at least one of said platforms and a second end of the first flange, opposite the first end of the first flange, which is free, and a second flange extending cylindrically in relation to the axis of revolution of said stator sector, the second flange includes a first end of the second flange fixed to the first flange and a second end of the second flange, opposite the first end of the second flange, which is free, and wherein at least one non-opening free flexibility-increasing cutout is disposed on a surface of the first flange and a surface of the second flange.

2. The stator sector as claimed in claim 1, wherein the at least one non-opening free flexibility-increasing cutout is a hole.

3. The stator sector as claimed in claim 2, wherein the hole is located on the first end of the first flange.

4. The stator sector as claimed in claim 1, further comprising at least one tangential locking means.

5. The stator sector as claimed in claim 4, wherein the at least one tangential locking means is an indentation.

6. A bladed stator comprising at least one stator sector as claimed in claim 1.

7. A turbine comprising at least one stator as claimed in claim 6.

8. A turbo-engine comprising a turbine as claimed in claim 7.

9. The stator sector as claimed in claim 1, wherein the flange is configured for axial locking or radial locking.

10. The stator sector as claimed in claim 1, wherein the at least one non-opening free flexibility-increasing cutout is disposed on the first end of the first flange and the first end of the second flange.

11. A method for increasing the flexibility of a bladed stator sector for a turbo-engine, comprising:

machining at least one non-opening cutout in a surface of a first flange and a second flange of the stator sector, wherein the sector comprises platforms including an inner platform and an outer platform and at least one blade fixed between said platforms, and wherein at least one of said platforms comprises the first flange and the second flange, the first flange extending in a radial plane in relation to an axis of revolution of the stator sector, the first flange includes a first end of the first flange fixed to the at least one of said platforms and a second end of the first flange, opposite the first end of the first flange, which is free, and the second flange extending cylindrically in relation to the axis of revolution of the stator sector, the second flange includes a first end of the second flange fixed to the first flange and a second end of the second flange, opposite the first end of the second flange, which is free.

12. The method as claimed in claim 11, wherein the flange is configured for axial locking or radial locking.

* * * * *